US007195604B2

(12) United States Patent
Nakamura et al.

(10) Patent No.: US 7,195,604 B2
(45) Date of Patent: Mar. 27, 2007

(54) MASSAGE MACHINE WITH RECESS HAVING A BOTTOM WALL AND OPPOSITE SIDE WALLS THAT ARE INFLATABLE

(75) Inventors: Takashi Nakamura, Kasai (JP); Toshiki Koma, Himeji (JP); Takamasa Suzuki, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 247 days.

(21) Appl. No.: 10/910,410

(22) Filed: Aug. 3, 2004

(65) Prior Publication Data

US 2005/0033204 A1 Feb. 10, 2005

(30) Foreign Application Priority Data

Aug. 8, 2003 (JP) ..... 2003-289541

(51) Int. Cl.
*A61H 23/04* (2006.01)
*A61H 7/00* (2006.01)

(52) U.S. Cl. ..... 601/136; 601/148; 601/149

(58) Field of Classification Search ..... 601/98, 601/101

See application file for complete search history.

(56) References Cited

U.S. PATENT DOCUMENTS 6,171,266 B1 * 1/2001 Inada et al. ..... 601/99
6,517,500 B2 * 2/2003 Ichikawa ..... 601/98

* cited by examiner

*Primary Examiner*—Danton DeMille
(74) *Attorney, Agent, or Firm*—Arnold B. Silverman; Robert A. Diaz; Eckert Seamans Cherin & Mellott, LLC

(57) ABSTRACT

An object of the invention is to provide a massage unit wherein means for massaging the affected part of the person to be treated is provided with means for moving the affected part so as to give massage to a desired position.

The massage unit of the invention comprises a recessed receiving portion 14 having a bottom wall 18 and opposite side walls 20, 21 extending upward from respective opposite sides of the bottom wall 18 for accommodating the affected part of the user therein, position adjusting means 15, 15*a* provided on the inner surfaces of the respective side walls 20, 21 of the recessed receiving portion 14 and movable toward the other side wall, and massage means 24 disposed on the bottom wall 18 of the recessed receiving portion 14 for massaging the affected part.

1 Claim, 8 Drawing Sheets

MASSAGE MACHINE WITH RECESS HAVING A BOTTOM WALL AND OPPOSITE SIDE WALLS THAT ARE INFLATABLE

TECHNICAL FIELD

The present invention relates to massage units having recessed receiving portions which are adapted to give massage at the bottoms thereof to the feet or like affected parts as placed therein.

BACKGROUND ART

Foot massage units are available which are adapted to massage the soles or like affected parts of the person to be treated and which comprise recessed receiving portions for placing the feet thereinto, and a foot holding cover for covering the insteps. The person to be treated inserts his or her feet into the respective receiving portions to have the insteps pressed by the holding cover, and is given massage on the soles by pressure members projecting upward from behind the soles (see the publication of JP-A No. 2000-167021).

With the massage unit described, the pressure members serving as massage means are movable usually only forwardly and backwardly of the recessed receiving portions but are not movable leftward or rightward. Thus, the pressure members are reciprocatingly movable forward and backward on the same line and are therefore unable to uniformly massage the entire soles or to give massage to a position laterally away from the line of the movement of the members.

Accordingly, if the line of the movement differs from the desired position, for example, due to a difference in the size of the foot of the person to be treated, the person is likely to feel discomfort. The pressure members are further unable to massage the soles at the arch side thereof where a high therapeutic effect can be given.

Furthermore, the foot is very difficult to place into or bring out of the recessed receiving portion because the foot holding cover becomes an obstacle, while it is likely that the foot holding cover feels tight.

An object of the present invention is to provide a massage unit wherein the means for massaging the affected part of the person to be treated is provided with means for moving the affected part so as to give massage to a desired position.

DISCLOSURE OF THE INVENTION

To fulfill the above object, the present invention provides a massage unit which comprises: a recessed receiving portion having a bottom wall and opposite side walls extending upward from respective opposite sides of the bottom wall for accommodating an affected part of the user therein; position adjusting means provided on an inner surface of one of the side walls of the recessed receiving portion and movable toward the other side wall; and massage means disposed on the bottom wall of the recessed receiving portion for massaging the affected part.

The distance between the side walls is variable by the position adjusting means. The affected part of the person to be treated, i.e., the user, can therefore be held reliably. The affected part can further be moved relative to the massage means by actuating the position adjusting means while the affected part is being held by the adjusting means. The user can therefore be given an effective massage at the desired position.

The position adjusting means can be an air bag provided on one or each of the opposite side walls of the recessed receiving portion.

The use of the air bag results in the advantage that the distance between the side walls and the position thereof are adjustable by a simple construction.

Preferably, the massage means is made variable in the intensity of massage.

The massage unit thus constructed is adapted to massage the affected part with varying intensities, enabling the user to feel as if being manually given a natural massage.

BEST MODE OF CARRYING OUT THE INVENTION

A description will be given of the best embodiments of massage units of the invention as installed in massage machines of the chair type.

The embodiments to be described below are massage units to which the invention is applied for massaging feet as the affected parts of the person to be treated. The massage units to be described comprise pressure members serving as massage means and side air bags arranged in recessed receiving portions and serving as position adjusting means.

[First Embodiment]

The first embodiment is a foot massage unit 4 to which the invention is applied.

Figure 1:
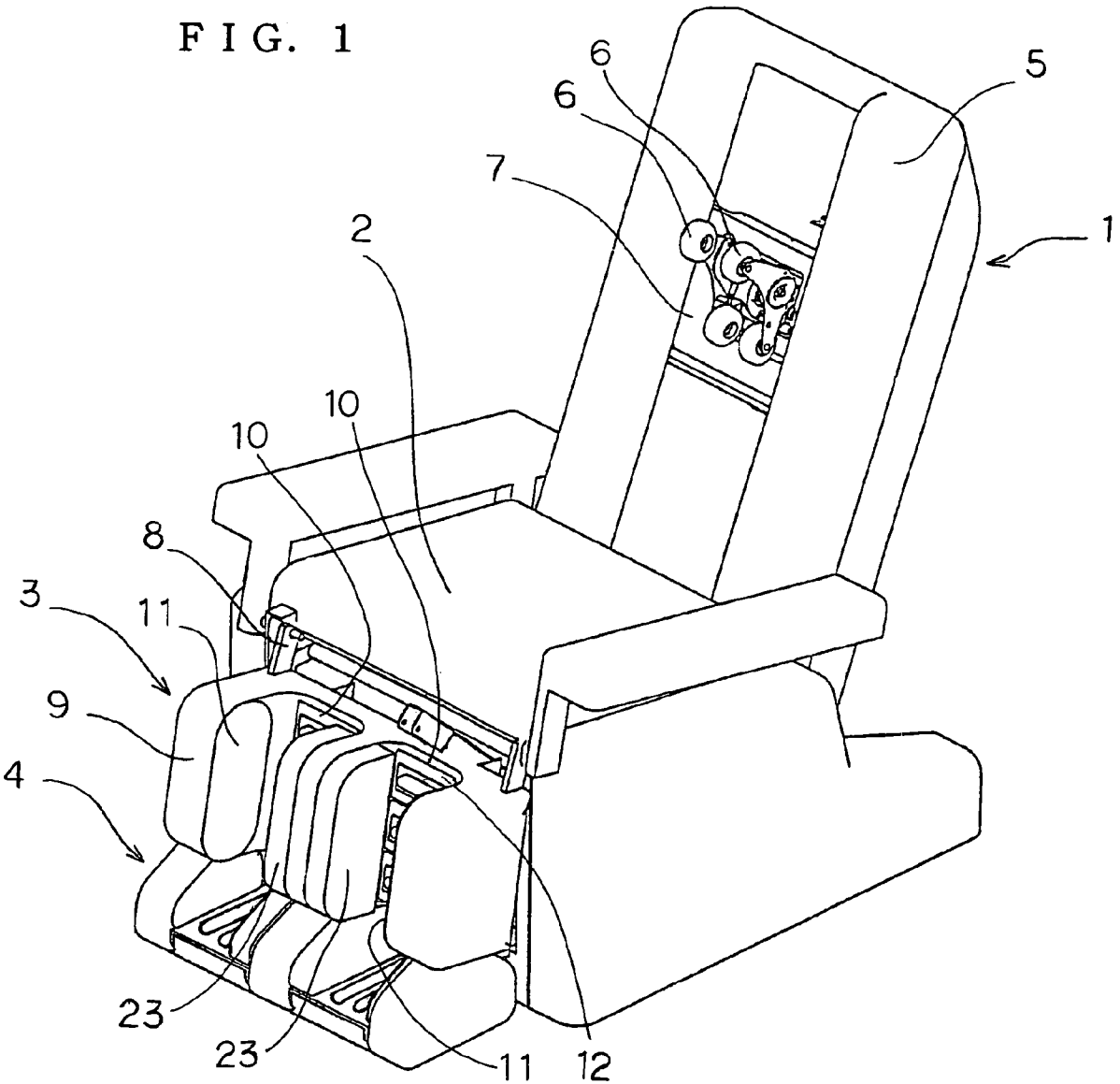
FIG. 1 is a perspective view of a massage machine of the chair type comprising a massage unit of first embodiment.

The foot massage unit 4 can be installed in a massage machine 1 of the chair type. With reference to FIG. 1, the massage machine 1 comprises a leg massage unit 3 positioned in front of a seat 2, and a foot massage unit 4 below the leg massage unit 3. The chair-type massage machine 1, as well as the leg massage unit 3, can be of known construction.

Figure 2:
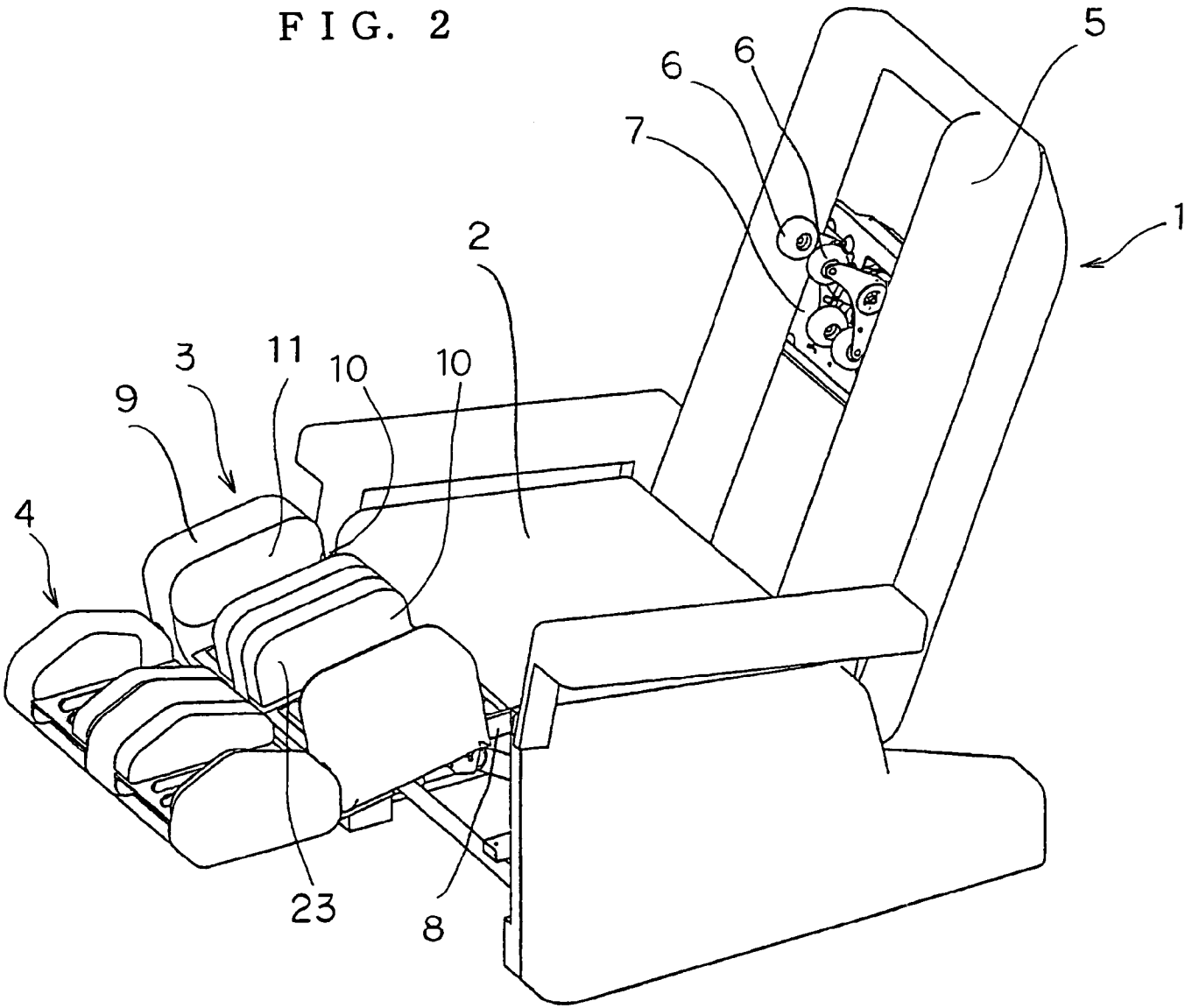
FIG. 2 is a perspective view of the massage unit of the massage machine as the unit is rotated to a horizontal position.

For example, the massage machine 1 comprises a massage mechanism 7 having a pair of left and right therapeutic members 6, 6 on a backrest 5 as shown in FIGS. 1 and 2. The massage mechanism 7 is movable upward and downward along the backrest 5 and is adapted to give a kneading massage to the person to be treated by moving the therapeutic members 6, 6 toward or away from each other, and to give a tapping massage by pivotally moving the therapeutic members 6, 6 upward and downward. The backrest 5 is covered with a fabric although not shown and connected to the seat 2 so as to be tiltable relative thereto and positionable at a desired angle therewith.

The leg massage unit 3 is connected by a connecting frame 8 to the front portion of the seat 2 so as to be pivotally movable and positionable at a desired angle. The leg massage unit 3 has a massage case 9 which is provided with a pair of recessed receiving portions 10 each U-shaped in cross section for inserting thereinto the legs (calves) of the person to be treated. Each recessed receiving portion 10 has a side air bag 11 provided on one side wall thereof and serving as holding means, and an elastic member 23 provided on the other side wall thereof. Each recessed receiving portion 10 further has a bottom wall provided with a pressing bottom air bag 12.

The foot massage unit 4 is connected to the lower end of the leg massage unit 3 as shown in FIGS. 1 and 2. The foot massage unit 4 is connected to the unit 3 by a link mechanism (not shown) so as to be held in a horizontal position relative to the floor at all times, such that even if the leg massage unit 3 is pivotally moved upward, the foot massage unit 4 remains substantially horizontal as shown in FIG. 2. Accordingly, when seated on the massage machine 1 in the state of FIG. 2, the person to be treated can stretch his or her legs forward.

Figure 3:
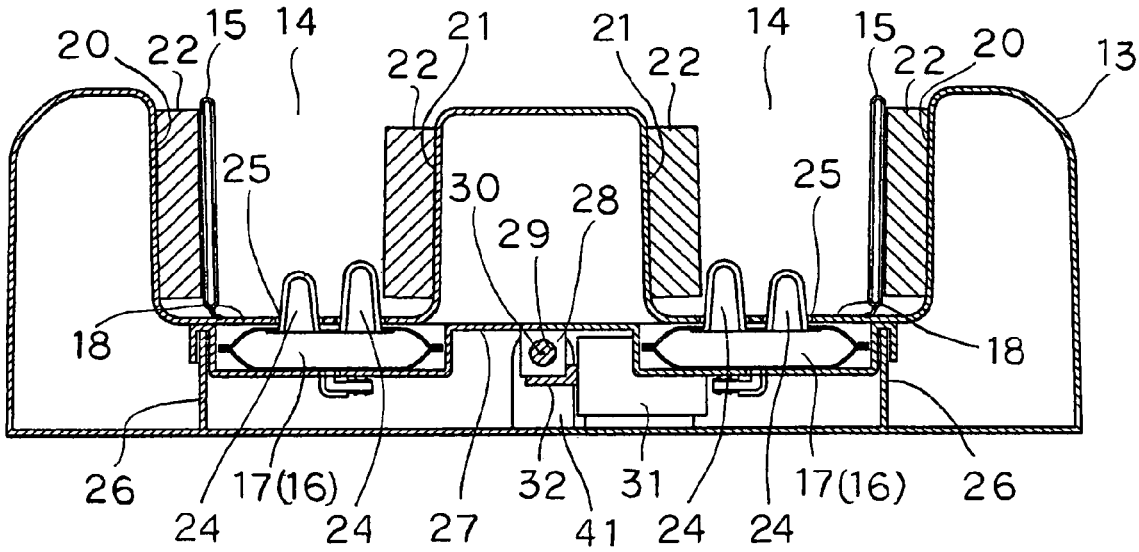
FIG. 3 is a sectional view of a foot massage unit.

As shown in FIG. 3, the foot massage unit 4 consists mainly of a casing 13 provided with a pair of recessed receiving portions 14, 14 for the person to be treated to insert his or her feet (the parts below the ankles) thereinto. Each recessed receiving portion 14 is provided with a side air bag 15 serving as holding means, and pressure member drive means 16 for driving pressure members 24, 24 serving as massage means. For example, a bottom air bag 17 is usable as the pressure member drive means 16 as shown in FIG. 3. The pressure member drive means 16 is not limited to this example, but may comprise a motor as is the case with a second embodiment.

Figure 4:
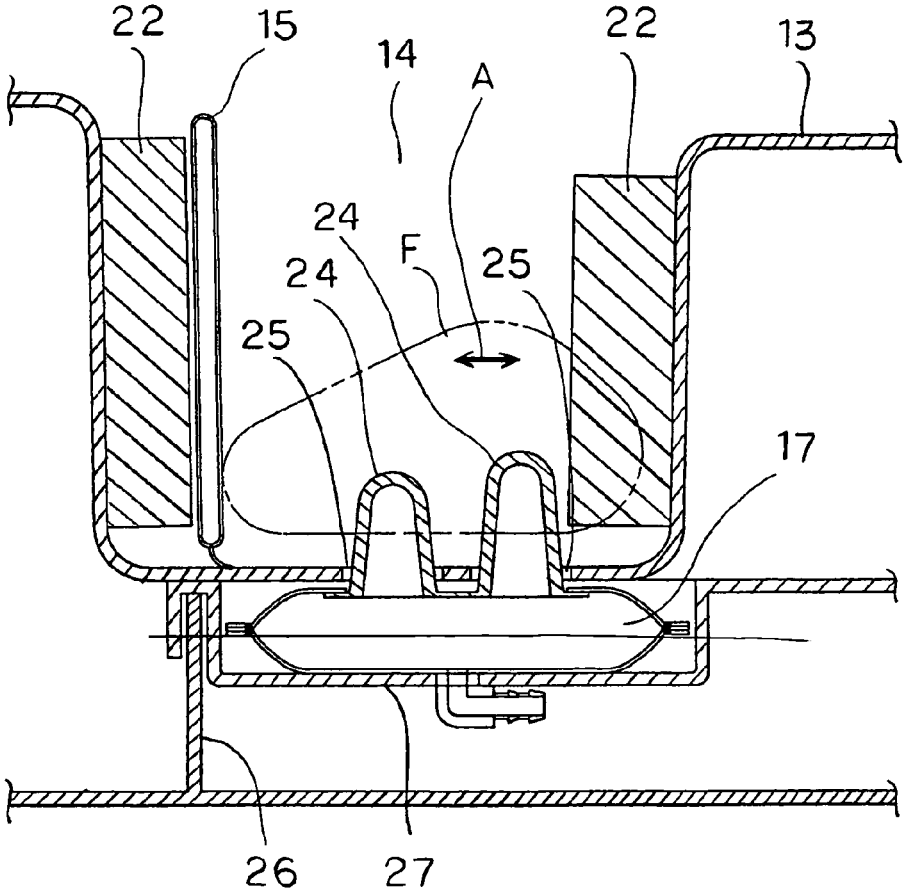
FIG. 4 is an enlarged view in section of a bottom air bag of the foot massage unit.
Figure 5:
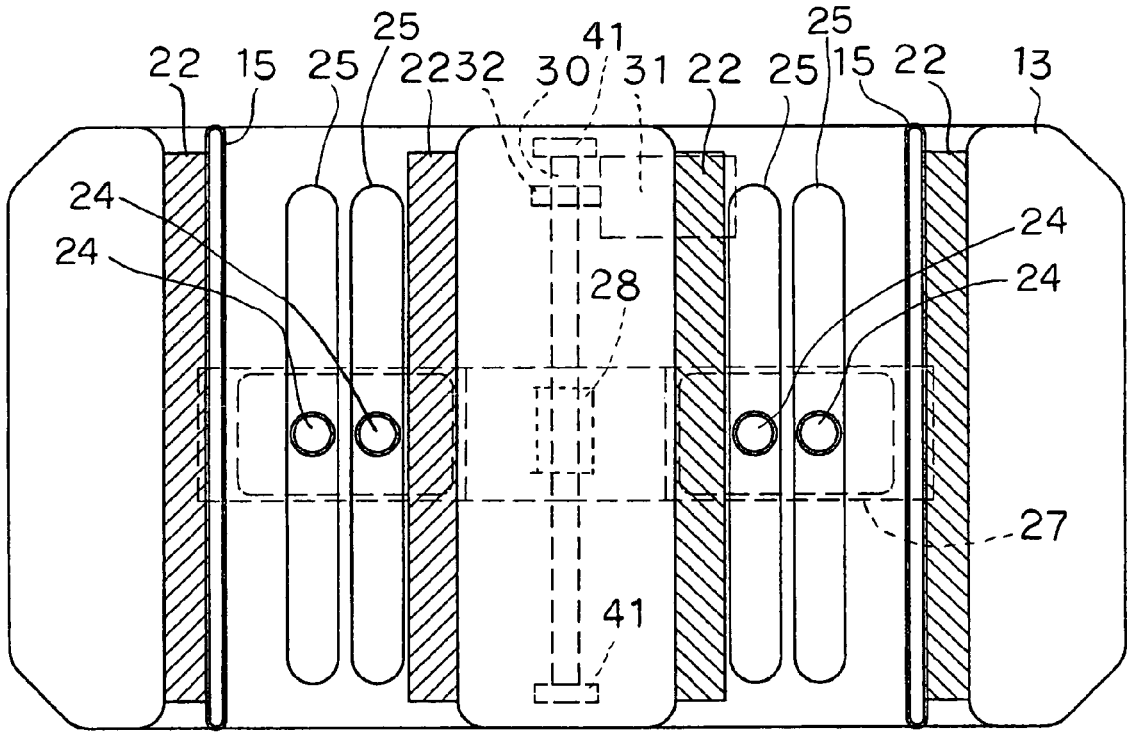
FIG. 5 is a plan view of the foot massage unit.
Figure 6:
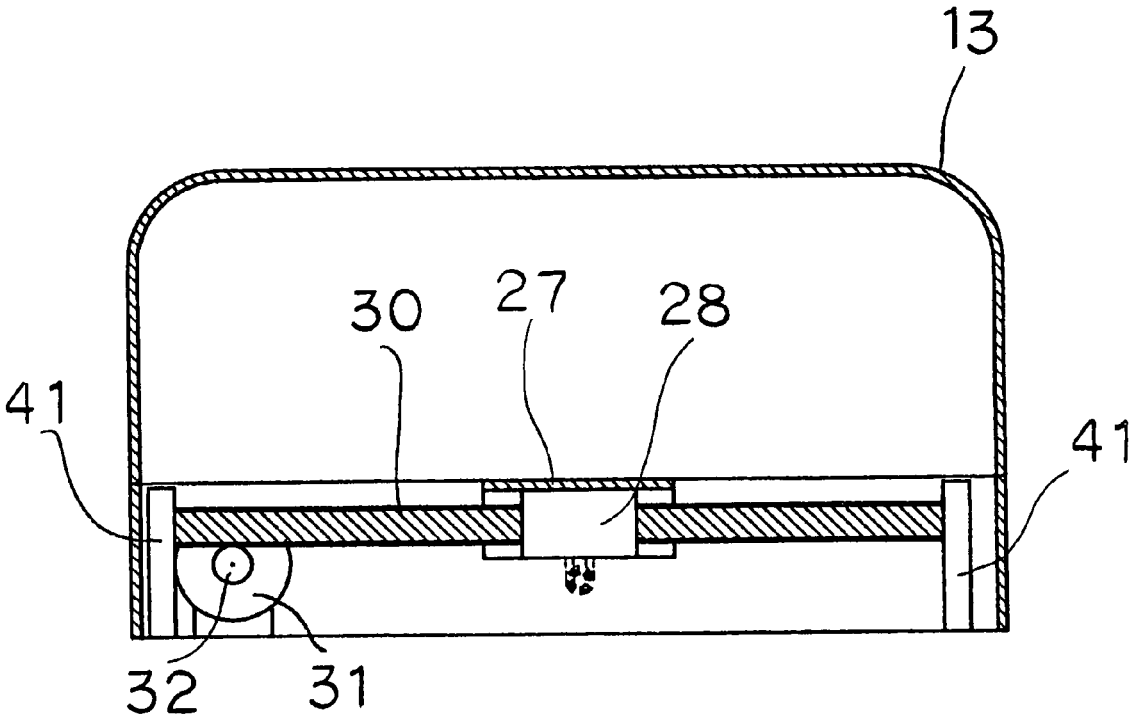
FIG. 6 is a sectional view of the foot massage unit for showing the relationship between a shaft and a motor.
Figure 7:
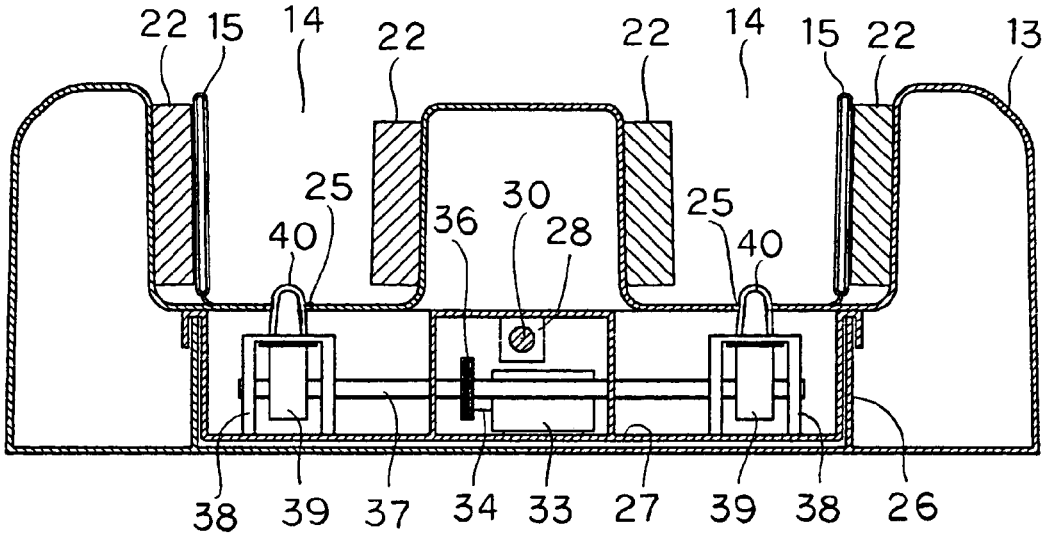
FIG. 7 is a sectional view of a foot massage unit of second embodiment.
Figure 8:
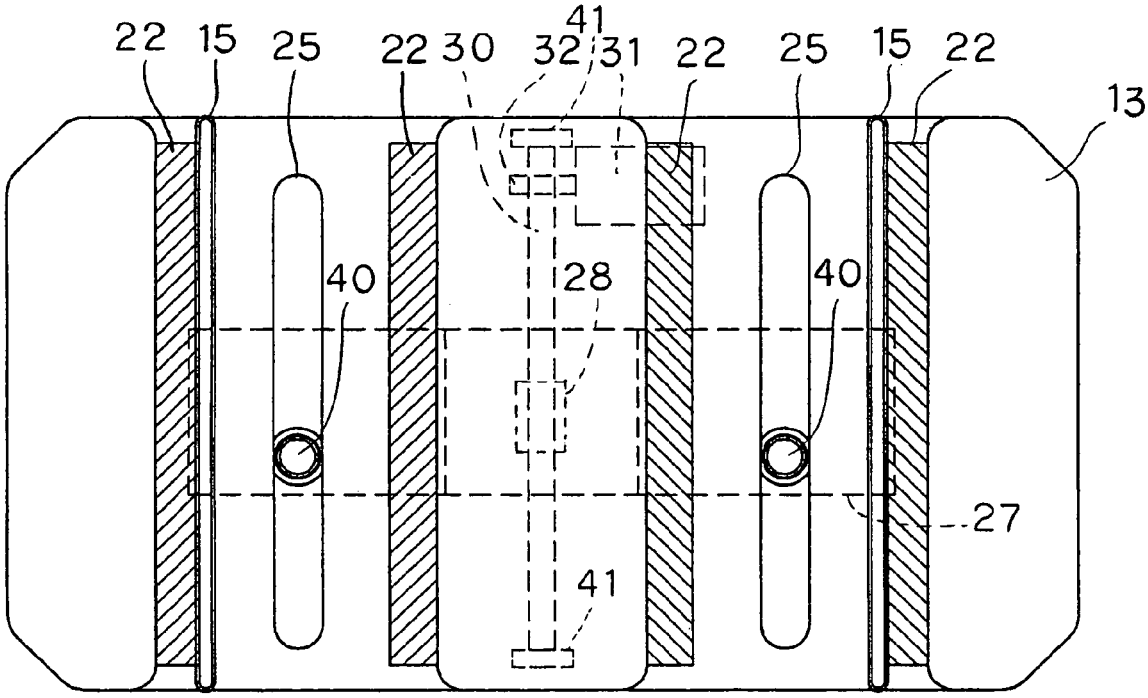
FIG. 8 is a plan view of the foot massage unit.
Figure 9:
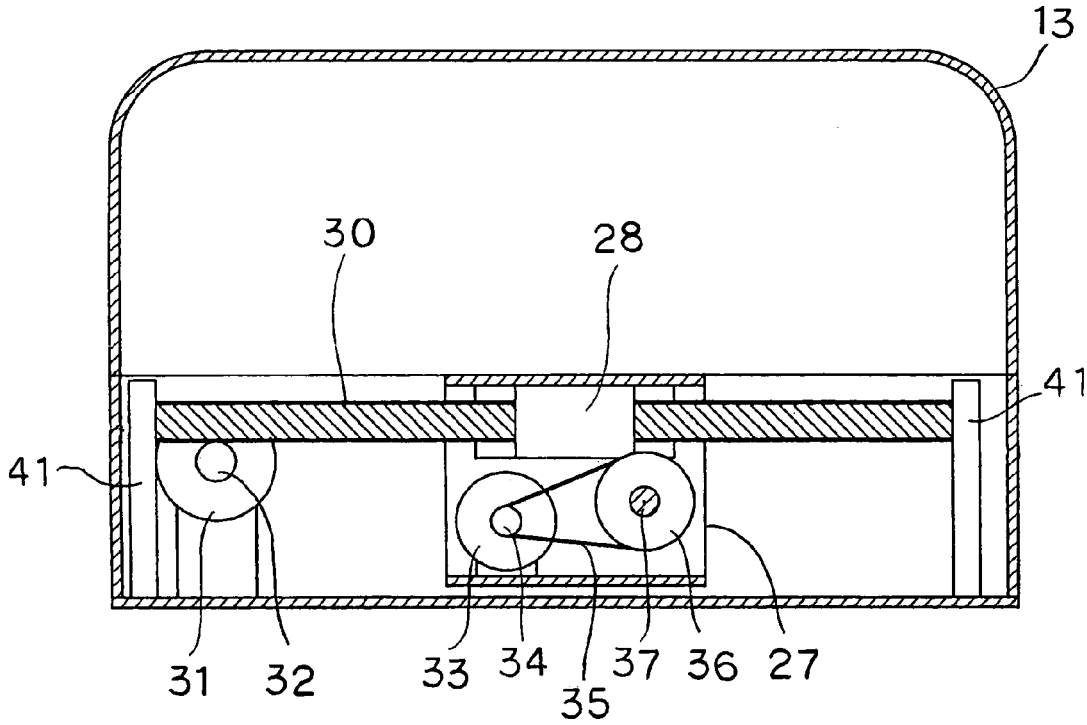
FIG. 9 is a sectional view of the foot massage unit showing the relationship between a motor and a shaft

With reference to FIGS. 3 to 5, the recessed receiving portion 14 comprises a bottom wall 18, a first side wall 20 and a second side wall 21 opposed to the wall 20, the first and second side walls 20, 21 extending upward from respective opposite sides of the bottom wall 18. The casing 13 can be made, for example, from a resin.

An elastic member 22 is affixed to the inner surface of each of the first and second side walls 20, 21. The side air bag 15 serving as position adjusting means is attached to the inner surface of the elastic member 22 on the first side wall 20. The side air bag 15 is connected to an air pump (not shown) via a valve and inflated by receiving the supply of air from the air pump. The elastic member 22 to be used preferably has such elasticity that the corresponding side of the foot of the person to be treated will become embedded therein when the side air bag 15 is inflated. The elastic member 22 can be made of urethane resin, sponge, expanded resin or the like.

With reference to FIGS. 3 and 4, the bottom wall 18 of the recessed receiving portion 14 is provided with the bottom air bag 17 serving as the pressure member drive means 16. Projecting from the bottom air bag 17 are the pressure members 24, 24 serving as massage means. The pressure member 24, 24 can be made from urethane resin or the like. The bottom air bag 24 is made by laminating urethane resin to a nylon fabric, making the laminated fabric into a bag by thermal bonding, making holes in the bag for inserting the pressure members 24 therethrough, and fitting and bonding the pressure members 24 to the bag. The bottom air bag 17 is connected to an air pump (not shown) via a valve and inflated by receiving the supply of air from the air pump. The pressure members 24 are attached to the flexible bottom air bag 17, so that when the bottom air bag 17 is inflated, the entire pressure members 24 fit to the affected part without applying pressure to the affected part only locally.

The bottom wall 18 of each recessed receiving portion 14 has slots 25, 25 for the respective pressure members 24, 24 to project outward therethrough when the bottom air bag 17 is inflated. The pressure members 24, 24 have such a length that when the bottom air bag 17 is in a contracted state, these members 24, 24 will project through the slots 25 slightly or will not project beyond the wall 18. This eliminates the likelihood that if placing the foot F on the bottom wall 18, the person to be treated will feel pain or discomfort upon coming into contact with the pressure members 24.

The bottom air bag 17 is provided so as to be movable inside the recessed receiving portion 14 longitudinally thereof. Stated more specifically, the bottom air bags 17, 17 are placed on a frame 27 movably supported by guides 26, 26 provided upright on opposite sides of bottom of the casing 13. A nut 28 is attached to the center of the frame 27 and is internally threaded as at 29 centrally thereof. A shaft 30 which is externally threaded over the entire length thereof is in screw-thread engagement with the threaded portion 29 of the nut 28. The shaft 30 is rotatably supported by bearings 41, 41 arranged at front and rear opposite ends of the casing 13. The shaft 30 is in screw-thread engagement with the output shaft 32 of a motor 31 which is disposed close to one end of the shaft 30. When driven, the motor 31 rotates the shaft 30 by the output shaft 32. The frame 27 fixed to the nut 28 is moved on the guides 26, 26 by the rotation of the shaft 30 by virtue of the thrust of the screw.

The bottom air bags 17, 17 are attached to the frame 27 and therefore move with the frame 27 along the bottom walls 18 of the recessed receiving portions 14. The bottom air bags 17 are freely movable reciprocatingly along the bottom walls 18 of the recessed receiving portions 14 by rotating the motor 31 forward or reversely.

Since the recessed receiving portions 14 are left open on the upper side, the person to be treated can readily place his or her affected parts, i.e., feet F, into the respective receiving portions 14.

By placing the foot F into each recessed receiving portion 14 and inflating the side air bag 15 serving as position adjusting means, the foot F is positioned in place as held between the side air bag 15 and the elastic member 22 opposed to the bag 15. The arrangement inside the receiving portion 14 does not feel tight since the upper side of the portion 14 is left open. In this state, the bottom air bag 17 is inflated and the motor 31 is driven, whereby the entire sole can be massaged with the pressure members 24, 24.

The position of the foot F is shiftable leftward or rightward relative to the pressure members 24, 24 by adjusting the degree of inflation of the side air bag 15. (The directions of movement of the foot F are indicated by an arrow A in FIG. 4.) Stated more specifically, the force pressing the foot F against the elastic member 22 is lessened by reducing the inflation of the side air bag 15, so that the foot F is positioned toward the side air bag 15 away from the center. Thus, the foot F is shifted leftward in FIG. 4. This enables the pressure members 24, 24 to massage the foot around the arch effectively. Conversely, the foot F of the person to be treated is shifted in such a direction (rightward in the drawing) that the foot is forcibly pressed against the elastic member 22 by inflating the side air bag 15 greatly. Accordingly, the foot F can be massaged effectively on the part opposite to the arch of the foot by the pressure members 24, 24.

In this way, the foot F of the person to be treated can be shifted leftward or rightward relative to the pressure members 24, 24 by varying the degree of inflation of the side air bag 15 serving as position adjusting means, enabling the members 24, 24 to massage the foot F over a wide region.

Although the present invention is practiced as the foot massage unit 4 according to the first embodiment, the invention may be embodied as the leg massage unit 3. The invention may alternatively be embodied as a massage unit for other affected parts, for example, for massaging the arms.

[Second Embodiment]

Figure 10:
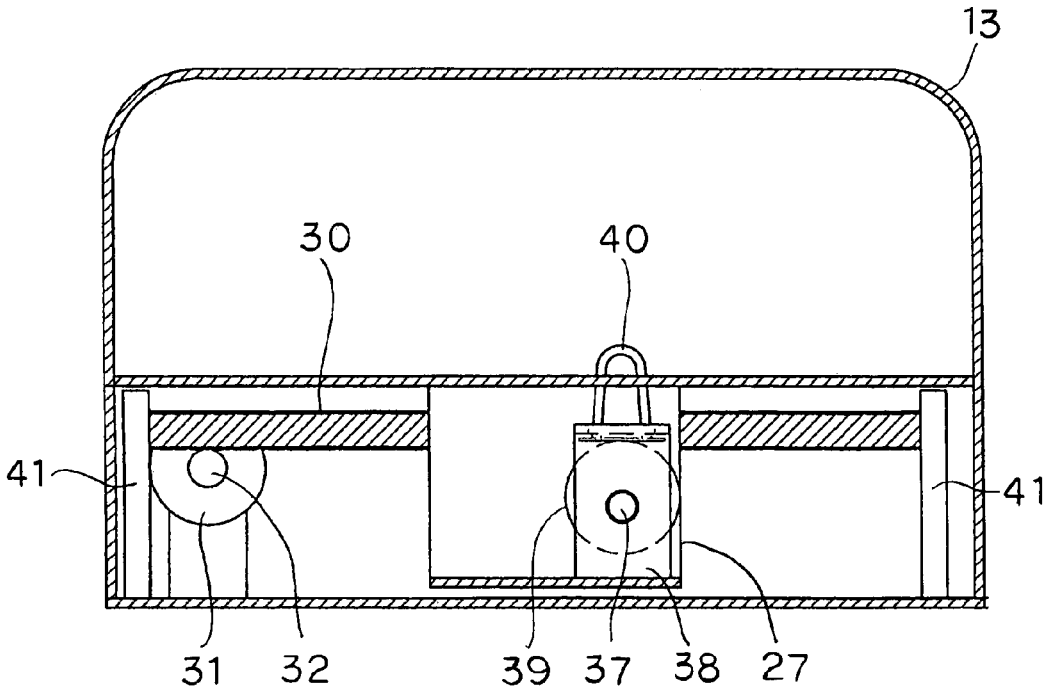
FIG. 10 is a sectional view of the foot massage unit showing the relationship between the shaft and an eccentric cam.

The second embodiment has pressure member drive means 16 which is different from that of the first embodiment. Throughout the drawings concerned, like parts are designated by like reference numerals and will not be described repeatedly. A motor 33 mounted on a frame 27 centrally thereof serves as a drive source for the pressure member drive means 16. The motor 33 has an output shaft 34 which is coupled to a pulley 36 by a belt 35. A shaft 37 is provided on the pulley 36 by a press fit centrally thereof. The shaft 37 is rotated with the pulley 36 by the rotation of the motor 33. The shaft 37 has its opposite ends rotatably supported by a generally U-shaped support members 38 on the frame 27. As shown in FIG. 10, a generally cylindrical cam 39 is eccentrically fixed to the shaft 37 at the portion thereof positioned inside the support member 38. A pressure member 40 movable upward and downward is provided between the cam 39 and the support member 38.

When driven, the motor 33 rotates the shaft 37 through the output shaft 34, belt 35 and pulley 36. The rotation of the shaft 37 causes the cam 39 to perform an eccentric motion, with the result that the pressure member 40 upwardly and downwardly movably mounted on the cam 39 moves upward and downward. Consequently, the height of the pressure member 40 beyond the support member 38 incessantly varies, permitting the pressure member 40 to massage the sole with varying intensities. The user therefore feels as if being manually given a natural massage. The sole can be given a wide variety of massages in its entirety by driving a motor 31 for moving the pressure member 40 forward and backward and thereby moving the member 40 forward and backward during an upward and downward movement.

Also according to the present embodiment, the foot is shiftable leftward or rightward relative to the pressure member 40 by adjusting the degree of inflation of the side air bag 15, whereby the sole can be massaged over a wide region.

[Third Embodiment]

Figure 11:
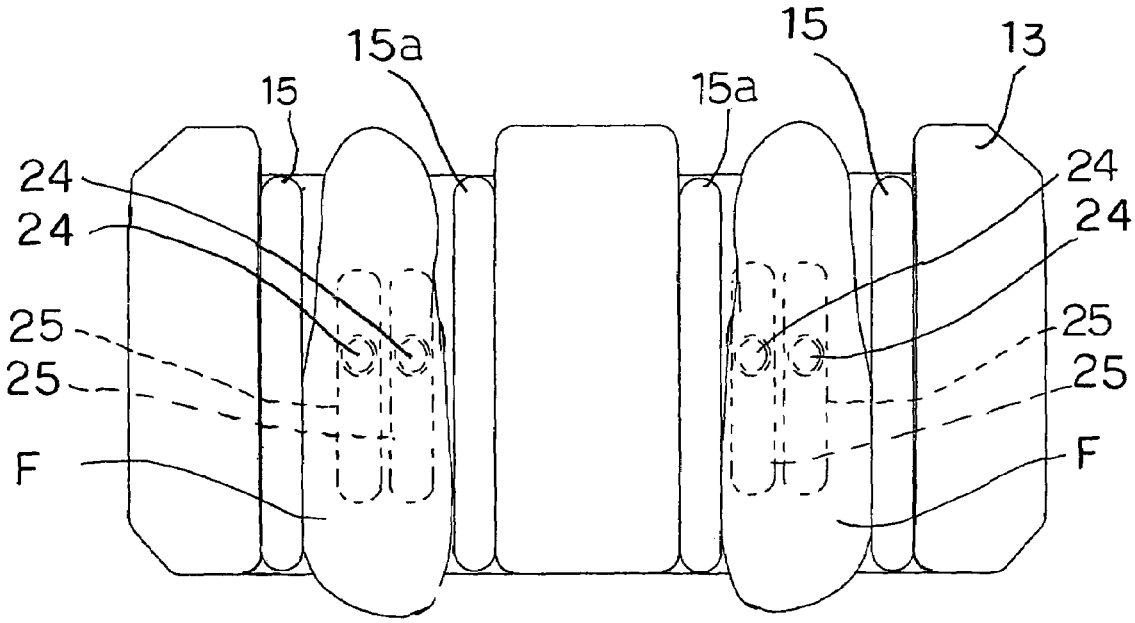
FIG. 11 is a plan view of a foot massage unit of third embodiment.
Figure 12:
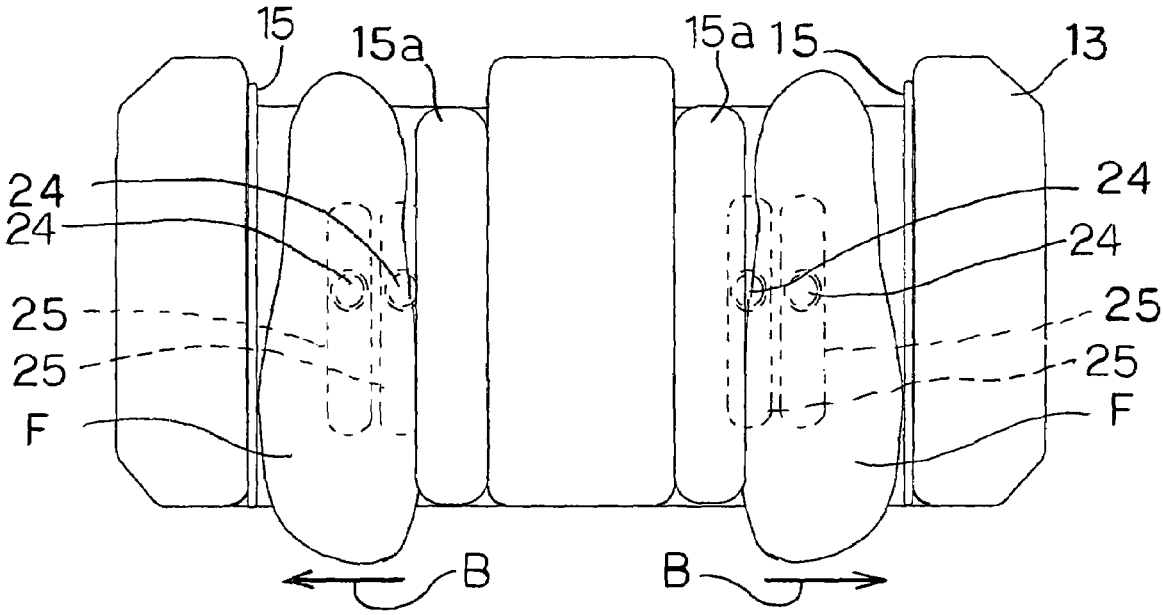
FIG. 12 is a plan view of the foot massage unit showing inner side air bags as inflated.
Figure 13:
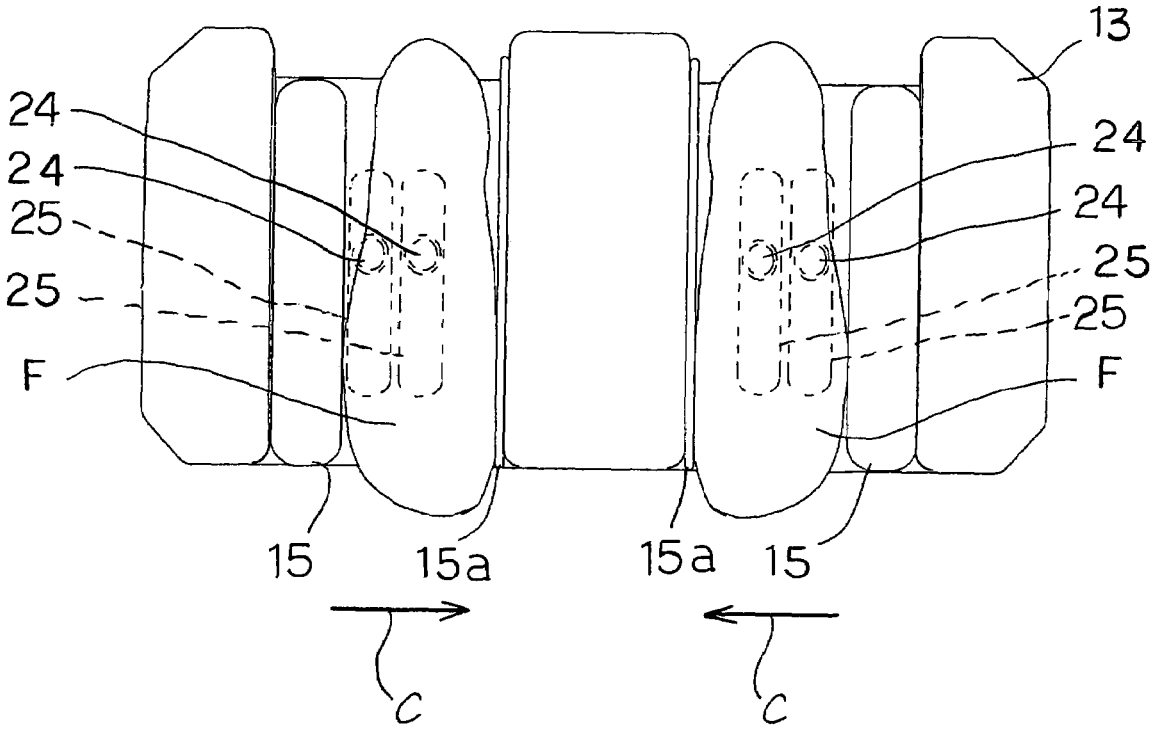
FIG. 13 is a plan view of the foot massage unit showing outer side air bags as inflated.

FIGS. 11 to 13 show a third embodiment of the invention, wherein side air bags 15, 15*a* are provided on the respective opposite side walls of the recessed receiving portion 14. Throughout the drawings concerned, like parts are designated by like reference numerals and will not be described repeatedly.

With reference to FIG. 11, side air bags 15, 15*a* are provided respectively on opposite side walls of each recessed receiving portion 14. This arrangement makes it possible to adjust the position of the foot F relative to the pressure members 24, 24 with greater ease.

For example, if the opposed side air bags 15, 15*a* are inflated equally as seen in FIG. 11, the foot F is positioned approximately in the center of the recessed receiving portion 14, consequently enabling the pressure members 24 to massage the sole emphatically approximately at the center thereof.

Further if only the side air bag 15*a* positioned closer to the center of the massage unit is inflated as shown in FIG. 12, the foot F is shifted toward the outer side of each recessed receiving portion 14 as indicated by an arrow B, permitting the pressure members 24 to come into contact with the arch of the foot F and massage the arch side mainly.

Further when only the side air bag 15 on the outer side of the recessed receiving portion 14 is inflated as seen in FIG. 13, the foot F is shifted toward the inner side of the portion 14 as indicated by an arrow C. The pressure members 24 therefore come into contact with the sole at the portion thereof opposite to the arch to massage the sole mainly on the outer side thereof.

Thus, the desired portion of the foot can be emphatically massaged by adjusting the degree of inflation of the side air bags 15, 15*a*.

The foot F of the person to be treated can be shifted leftward or rightward within the recessed receiving portion 14 by alternately repeating the inflation and contraction of the side air bag 15 and the side air bag 15*a*, whereby the sole can be uniformly massaged very effectively in its entirety.

Apparently, the present invention can be modified and altered by one skilled in the art without departing from the spirit of the invention. Such modification is included within the scope of the invention as set forth in the appended claims.

The invention claimed is:

1. A massage unit comprising:

a recessed receiving portion having a bottom wall, and first and second opposite side walls extending upward from a respective opposite sides of the bottomwall for accommodating an affected part of the user therein;

massage means disposed on the bottom wall of the recessed receiving portion for massaging the affected part;

a first airbag disposed to overlie an entire area of the first side wall of the recessed receiving portion;

a second airbag disposed to overlie an entire area of the second side wall of the recessed receiving portion; and the first and second airbags being operable differently from each other between inflation and deflation, so that the affected part of the user can be shifted in the recessed receiving portion and adjusted to receive a massage action from the massage means.

* * * * *